US007585090B2

(12) United States Patent
Wu

(10) Patent No.: US 7,585,090 B2
(45) Date of Patent: Sep. 8, 2009

(54) LIGHT-EMITTING-DIODE LAMP

(76) Inventor: Tsu Yao Wu, 10th Fl., No. 15, Lane 74, Sec. 3, Chenggong Rd., Neihu District, Taipei City (TW)

( * ) Notice: Subject to any disclaimer, the term of this patent is extended or adjusted under 35 U.S.C. 154(b) by 0 days.

(21) Appl. No.: 12/003,240

(22) Filed: Dec. 21, 2007

(65) Prior Publication Data

US 2009/0161381 A1 Jun. 25, 2009

(51) Int. Cl.
*F21S 4/00* (2006.01)

(52) U.S. Cl. ..... 362/249.02; 362/240; 362/249.06; 362/646; 362/657; 340/815.45

(58) Field of Classification Search ..... 362/240, 362/252, 646, 657, 800, 249.02, 249.06; 340/815.45
See application file for complete search history.

(56) References Cited

U.S. PATENT DOCUMENTS 6,525,668 B1 * 2/2003 Petrick ..... 340/815.45
6,621,222 B1 * 9/2003 Hong ..... 362/800
7,086,756 B2 * 8/2006 Maxik ..... 362/800
7,387,403 B2 * 6/2008 Mighetto ..... 362/800

* cited by examiner

*Primary Examiner*—Stephen F Husar
(74) *Attorney, Agent, or Firm*—Rosenberg, Klein & Lee

(57) ABSTRACT

A light-emitting-diode (LED) lamp includes a control circuit board having a control circuit and a plurality of insertion holes provided thereon; a plurality of LED units, each of which including a circuit board, a plurality of LEDs mounted on the circuit board, and terminals provided at an end of the circuit board for plugging into the insertion holes on the control circuit board to thereby electrically assemble the LED unit to the control circuit board; and a glass bulb or tube for receiving the assembled control circuit board and LED units to complete the LED lamp that can be mounted to a general lamp holder. When electricity is supplied to the LED lamp, the LEDs are driven by the control circuit to emit light for illumination. The number of LED units and of the LEDs may be adjusted according to desired illuminance.

3 Claims, 5 Drawing Sheets

LIGHT-EMITTING-DIODE LAMP

FIELD OF THE INVENTION

The present invention relates to a light-emitting-diode (LED) lamp, and more particularly to an LED lamp that can be easily assembled and is adjustable in the number of LEDs thereof according to desired illuminance.

BACKGROUND OF THE INVENTION

The traditional electric bulbs consume high amount of electric energy and no longer meet nowadays requirement for energy saving. The illumination technology employing light-emitting diodes (LED) has been developed to replace the traditional electric bulbs with LED lamps for the purpose of energy saving. While the currently available LED lamps have high power to increase illumination thereof, they also produce high amount of heat during the operation thereof, and the produced heat is not easily dissipated. Moreover, the currently available LED lamps are not easy to assemble, and are not adjustable in the number of LEDs thereof for providing desired illuminance (lumen). Due to these factors, the current LED lamps always require high production cost. It is therefore tried by the inventor to develop an LED lamp that is easy to assemble and may have adjustable number of LEDs to meet different requirements for illuminance.

SUMMARY OF THE INVENTION

A primary object of the present invention is to provide an LED lamp that can be easily assembled and is adjustable in the number of LEDs thereof according to desired illuminance, so that the LED lamp can be produced at lowered cost and the heat produced by the LED lamp during the operation thereof can be reduced.

To achieve the above and other objects, the LED lamp according to the present invention includes a control circuit board having a control circuit and a plurality of insertion holes provided thereon; a plurality of LED units, each of which including a circuit board, a plurality of LEDs mounted on the circuit board, and terminals provided at an end of the circuit board; and a glass bulb or glass tube, in which the assembled LED units and control circuit board are received for electrically connecting to a general lamp holder. The LED units may be assembled to the control circuit board simply by plugging the terminals on the circuit boards of the LED units into the insertion holes on the control circuit board.

When an amount of electric current is supplied to the LED lamp via the lamp holder, the LEDs are driven by the control circuit to emit light for illumination.

The number of LED units and of the LEDs in the LED lamp may be adjusted according to desired illuminance.

It is possible to use a plurality of low-power LEDs instead of one single high-power LED to increase the illuminance while avoiding the production of high amount of heat. Therefore, the problem of heat dissipation in LED lamp may be solved.

The control circuit for the LED lamp of the present invention includes a rectification circuit for rectifying commercial power to a desired voltage for driving the LEDs to emit light, and a voltage stabilizing circuit for stabilizing the driving voltage.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
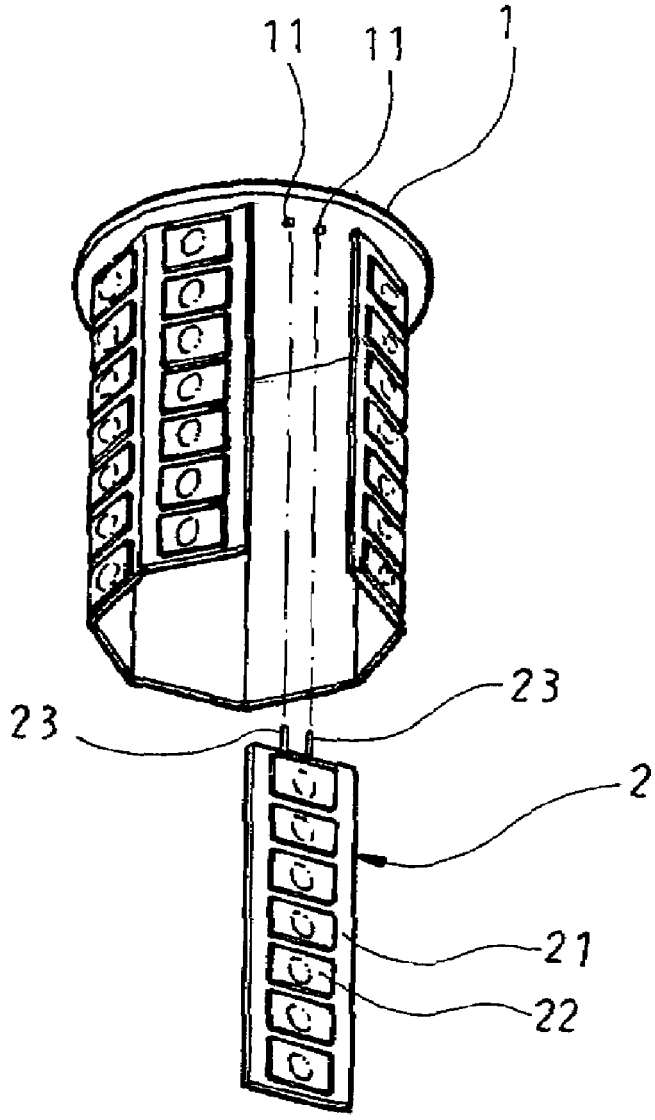
FIG. 1 is a partially exploded perspective view showing a control circuit board and a plurality of LED units for forming an LED lamp according to a first embodiment of the present invention.

Please refer to FIG. 1 that is a partially exploded perspective view showing a control circuit board 1 and a plurality of LED units 2 for forming a light-emitting-diode (LED) lamp according to a first embodiment of the present invention.

The control circuit board 1 is provided thereon a control circuit and a plurality of insertion holes 11 electrically connected to the control circuit. In the illustrated embodiment of the present invention, the control circuit board 1 is in the form of a disk, and the insertion holes 11 are octagonally arranged on the control circuit board 1.

Each of the LED units 2 includes a circuit board 21, a plurality of LEDs 22 mounted on the circuit board 21, and a plurality of terminals 23 provided on and projected from an end surface of the circuit board 21.

The LED units 2 are assembled to the control circuit board 1 and electrically connected to the control circuit by plugging the terminals 23 on the circuit boards 21 into the insertion holes 11 on the control circuit board 1.

Figure 2:
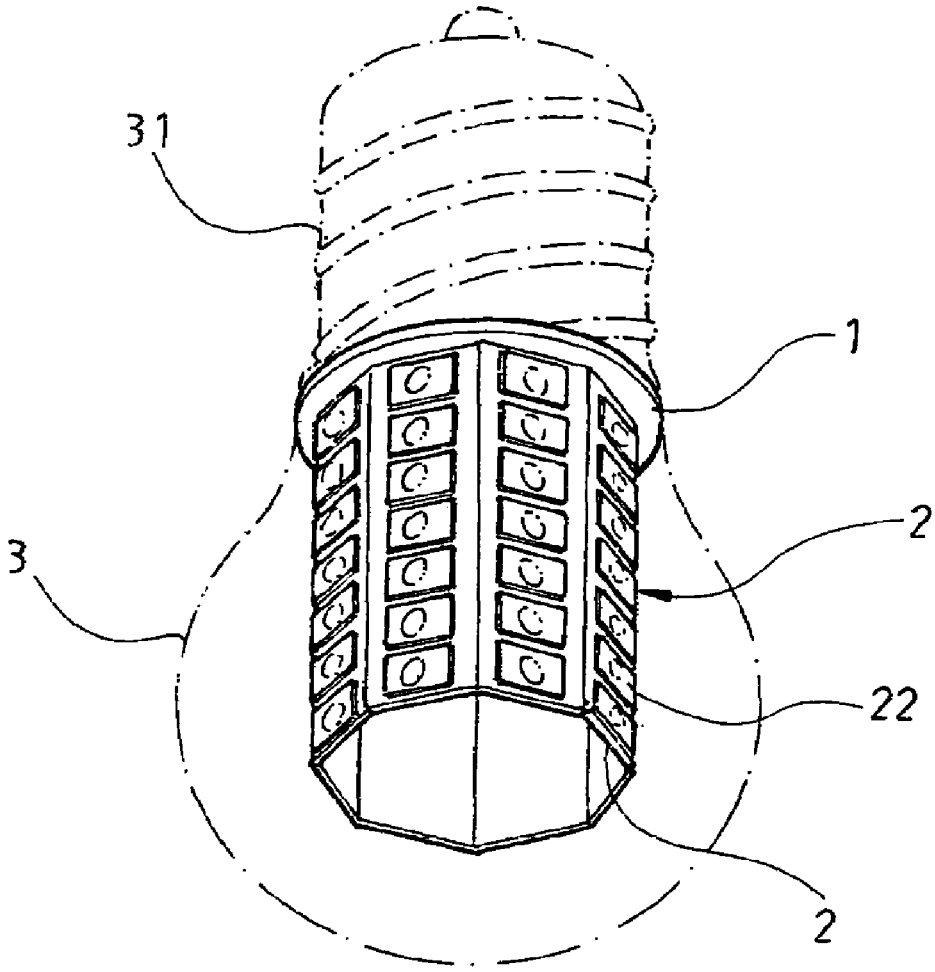
FIG. 2 is a phantom perspective view showing the assembled control circuit board and LED units are received in a glass bulb to complete the LED lamp according to the first embodiment of the present invention.
Figure 3:
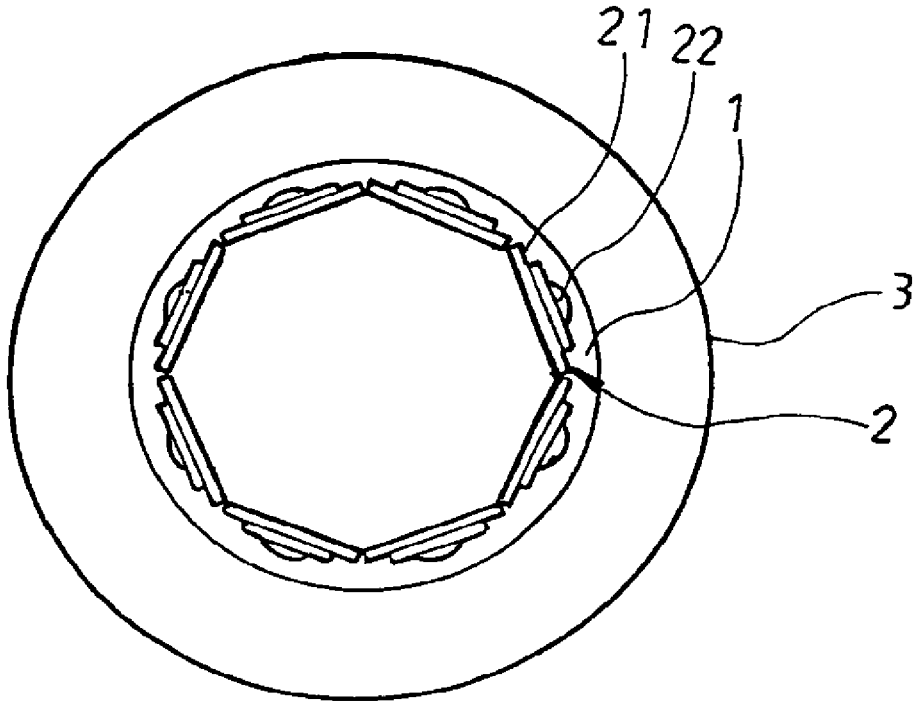
FIG. 3 is a cross-sectional view of FIG. 2.

Please refer to FIG. 2. The assembled control circuit board 1 and LED units 2 are then received in a glass bulb 3 to complete the LED lamp of the present invention. Wherein, the control circuit board 1 is electrically connected to a base 31 of the glass bulb 3. The completed LED lamp may be mounted on a general lamp holder (not shown), and commercial power may be supplied to the control circuit board 1 via the bulb base 31 to drive the LEDs 22 to emit light. Therefore, the LED lamp according to the present invention may be used to replace traditional electric bulbs for illumination.

The number of the LED units 2 or of the LEDs 22 may be adjusted according to required illuminance (lumen), so that the LED lamp of the present invention may be manufactured at lowered assembly cost. And, a plurality of low-power LEDs 22 instead of one single high-power LED may be used to reduce the power consumption of the LED lamp of the present invention to solve the problem of heat dissipation.

Particularly, the control circuit on the control circuit board 1 includes a rectification circuit and a voltage stabilizing circuit. The rectification circuit transforms the commercial power and converts alternating current into direct current for driving the LEDs 22 to emit light, and the voltage stabilizing circuit functions to stabilize the driving voltage.

Figure 4:
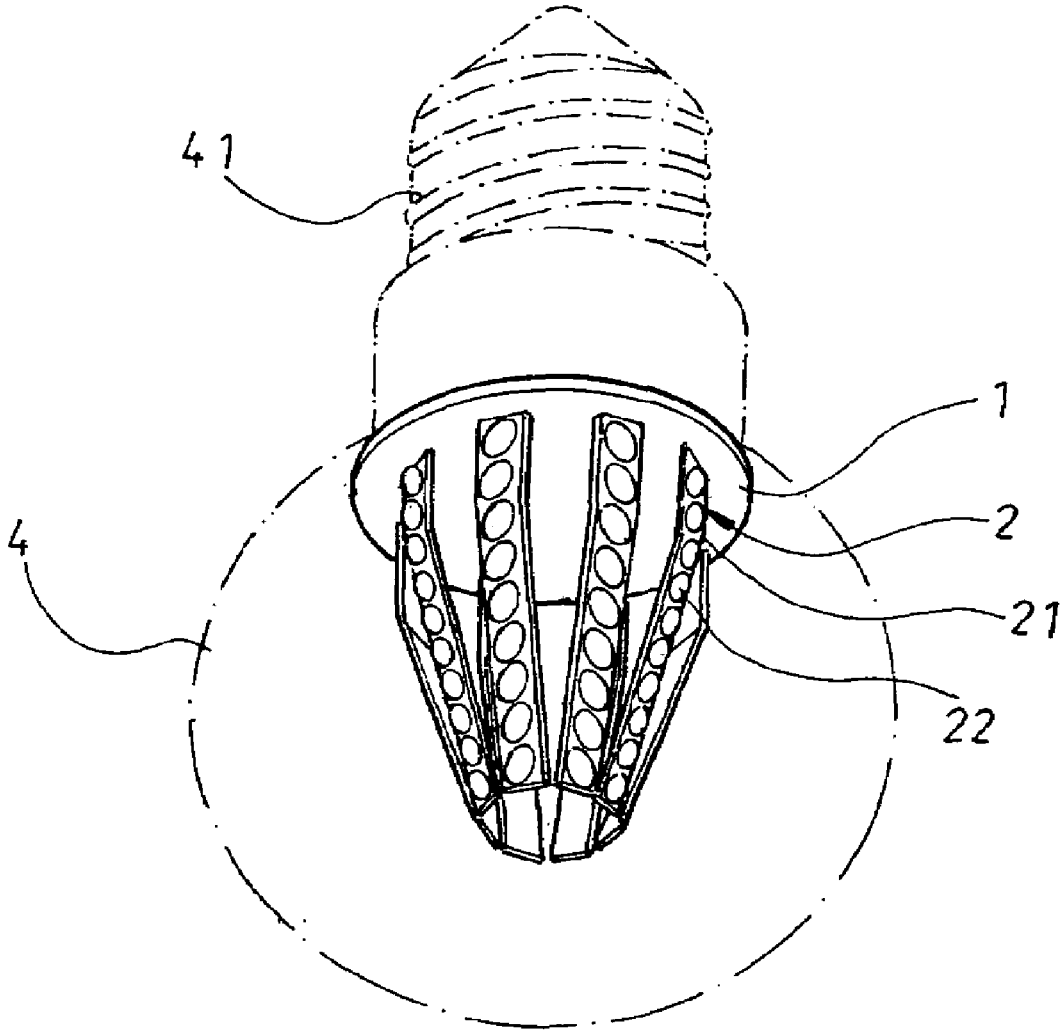
FIG. 4 is a phantom perspective view showing an LED lamp according to a second embodiment of the present invention.

FIG. 4 shows an LED lamp according to a second embodiment of the present invention. In the second embodiment, the circuit boards 21 of the LED units 2 are bent at a predetermined point, such that when the circuit boards 21 of the LED units 2 are assembled at an end to the control circuit board 1 via the terminals 23 and the insertion holes 11, free ends of the circuit boards 21 opposite to the control circuit board 1 are inward inclined toward one another, so that the LED units 2 together form a tapered conic shape suitable for mounting in a glass bulb 4 different from the glass bulb 3 in shape. Again, commercial power may be supplied to the control circuit board 1 via a base 41 of the bulb 4 to drive the LEDs 22 to emit light for replacing the traditional electric bulbs, making the LED lamp more practical for use. Similarly, the number of the LED units 2 or of the LEDs 22 may be adjusted according to required illuminance (lumen), so that the LED lamp may be produced at lowered assembly cost, and low-power LEDs 22 may be used to enable reduced power consumption by and easy heat dissipation from the LED lamp, which in turn facilitates energy saving and environmental protection.

Figure 5:
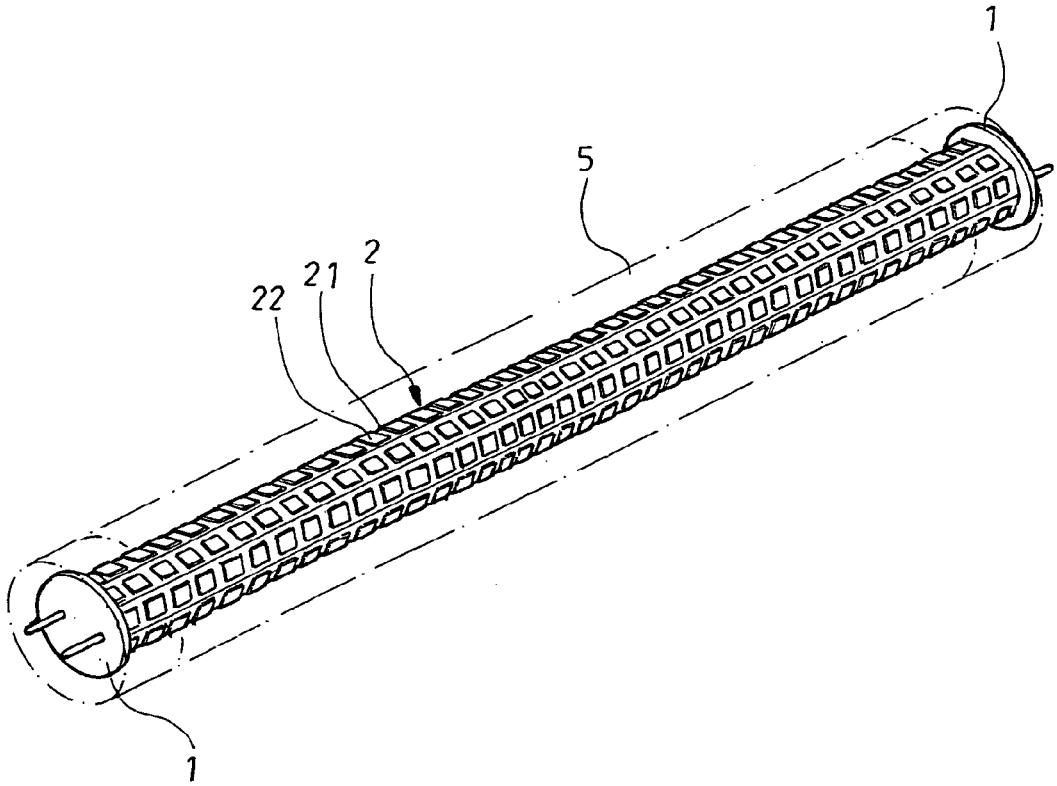
FIG. 5 is a phantom perspective view showing an LED lamp according to a third embodiment of the present invention.

FIG. 5 shows an LED lamp according to a third embodiment of the present invention. In the third embodiment, the circuit boards 21 for the LED units 2 are elongate in shape and have terminals provided at both ends thereof, and two control circuit boards 1 are separately electrically connected to two ends of the elongate circuit boards 21 of the LED units 2 to complete an elongate LED lamp suitable for mounting in a round-sectioned glass tube 5 to resemble a tubular fluorescent lamp. The elongate LED lamp may be connected to general fluorescent lamp holders (not shown) to replace the traditional fluorescent tubes for illumination. Similarly, the number of the LED units 2 or of the LEDs 22 may be adjusted according to required illuminance (lumen), so that the elongate LED lamp may be produced at lowered cost, and low-power LEDs 22 may be used to enable reduced power consumption by and easy heat dissipation from the LED lamp.

The glass bulb and glass tube for the LED lamp of the present invention may be internally provided with reflecting and refracting means or otherwise coated with a reflective layer to reflect and/or concentrate light source from the LEDs 22, so as to increase the illuminance of the LED lamp of the present invention. Moreover, the glass bulb and glass tube for the LED lamp of the present invention may be provided with heat dissipating holes or be filled with inert gas, enabling the LED lamp of the present invention to have enhanced heat dissipation efficiency.

With the above arrangements, the present invention provides an improved LED lamp that could be easily assembled and is adjustable in its illuminance by changing the number of the LED units 2 or of the LEDs 22 and/or using more low-power LEDs 22. With the reduced number of LED units 2 and/or LEDs 22 and the use of low-power LEDs 22, the LED lamp of the present invention may have lowered assembly cost, power consumption, and heat accumulation.

What is claimed is:

1. A light-emitting-diode (LED) lamp, comprising:

at least one control circuit board transversely disposed at a longitudinal end of the lamp, the control circuit board having provided thereon a control circuit and a plurality of insertion holes electrically connected to the control circuit;

a plurality of LED units being assembled to the control circuit board; each of the LED units including a circuit board, a plurality of LEDs mounted on the circuit board, and terminals provided on at least one end of the circuit board for plugging into the insertion holes on the at least one control circuit board; the circuit boards of the LED units being detachably coupled to the control circuit board with the LEDs electrically connected to the control circuit, the circuit boards thereby defining a reconfigurable frame structure projecting longitudinally from the control circuit board; and a glass bulb or tube for receiving the assembled control circuit board and LED units therein and mounting to a general lamp holder;

whereby when the glass bulb or tube is mounted to a lamp holder and an amount of commercial power is supplied thereto, the LEDs are driven by the control circuit to emit light for illumination.

2. The LED lamp as claimed in claim 1, wherein the circuit boards of the LED units are bent at a predetermined point each, such that when the circuit boards of the LED units are respectively connected at an end to the control circuit board via the terminals and the insertion holes, another ends of the circuit boards opposite to the control circuit board are inward inclined toward one another to adapt to different shapes of the glass bulb.

3. The LED lamp as claimed in claim 1, wherein the control circuit includes a rectification circuit for transforming the commercial power supplied thereto for driving the LEDs to emit light, and a voltage stabilizing circuit for stabilizing the driving voltage.

* * * * *